United States Patent [19]

Gloystein

[11] Patent Number: 4,732,505

[45] Date of Patent: Mar. 22, 1988

[54] COUPLING PIECE FOR CONNECTING CONTAINERS

[75] Inventor: Jürgen Gloystein, Osterholz-Scharmbeck, Fed. Rep. of Germany

[73] Assignee: Conver Ingenieur Technik GmbH & Co. KG, Bremen, Fed. Rep. of Germany

[21] Appl. No.: 836,483

[22] Filed: Mar. 5, 1986

[51] Int. Cl.[4] ..... B25G 3/00; B65D 21/02

[52] U.S. Cl. ..... 403/14; 403/348; 24/287; 410/89

[58] Field of Search ..... 403/316, 348, 116, 14; 24/287, 590, 591, 593; 410/89, 83; 108/53.1

[56] References Cited

U.S. PATENT DOCUMENTS

| | | | |
|---|---|---|---|
| 1,787,167 | 12/1930 | Purdy | 403/116 |
| 3,456,967 | 7/1969 | Tantlinger et al. | 24/287 |
| 3,556,456 | 1/1971 | Lunde . | |
| 3,612,466 | 10/1978 | Arnold | 410/83 |
| 3,691,595 | 9/1972 | Backteman et al. | 24/287 |
| 3,753,272 | 8/1973 | Laidley | 24/287 |
| 3,894,493 | 7/1975 | Strecker | 24/287 |
| 4,196,673 | 4/1980 | Looks | 24/287 |
| 4,212,251 | 7/1980 | Di Martino | 24/287 |
| 4,389,761 | 6/1983 | Gloystein et al. | 24/287 |
| 4,419,034 | 12/1983 | Di Martino | 410/83 |
| 4,437,211 | 3/1984 | Dorpmund | 24/287 |
| 4,564,984 | 1/1986 | Takaguchi | 24/590 X |
| 4,591,307 | 5/1986 | Clive-Smith | 24/287 X |

FOREIGN PATENT DOCUMENTS

| | | |
|---|---|---|
| 2204915 | 8/1972 | Fed. Rep. of Germany . |
| 3439134 | 5/1986 | Fed. Rep. of Germany . |

OTHER PUBLICATIONS

German Gebrauchsmuster No. G 84 02 894.7 (no translation available).

*Primary Examiner*—Andrew V. Kundrat
*Attorney, Agent, or Firm*—Burns, Doane, Swecker & Mathis

[57] ABSTRACT

The coupling piece for connecting two container corner fittings has a housing (10) with an upper and a lower middle piece (21/22), a locking bolt (15) and two crossbars (16 and 17) fastened to its free ends projecting from the housing (10). The lower middle piece (22) only partially matches the contour of an orifice in a container corner fitting, so that the lower crossbar (17) projects laterally beyond it. In the released position, the upper and lower crossbars (16 and 17) are rotated through an angle relative to one another, so that the lower crossbar (17) has to be introduced into the container corner fitting first and then the entire housing has to be rotated through this angle, before the upper crossbar (16) is correctly aligned opposite the orifice in the container corner fitting of the upper container.

9 Claims, 7 Drawing Figures

COUPLING PIECE FOR CONNECTING CONTAINERS

BACKGROUND OF THE INVENTION

The invention relates to a coupling piece for connecting containers. More particularly, the present invention concerns a coupling device for connecting containers which includes a locking bolt which is rotatable between a locking position and a release position.

By means of such a coupling piece, containers of standardized design can be connected together vertically on top of one another. For this purpose, the containers have corner fittings which conform to international standards and which have orifices in their horizontal surface. Coupling pieces of the type mentioned in the introduction, which are in general also referred to by the term "twistlock", are known, and in these the connecting force (anchoring force) is transmitted solely via the crossbars and the locking bolt.

Another type of known twist lock is referred to as a "permanent-base twistlock" in the specialized jargon. Its housing is equipped, at one end, with a foot which is anchored in the corner fitting of a (lower) container as a result of the rotation of the housing. Here, a crossbar is provided only at the top end of the locking bolt. The bottom end of the bolt is anchored rotatably in the housing or by means of small crossbars or flanges on the lower outer face of the housing. Here, the force is transmitted with the assistance of the housing. The disadvantage of the last-mentioned "permanent-base" type of twistlock is that it has a lower load-bearing capacity. This is because the rotary anchoring of the locking bolt in or on the housing is critical. On the other hand, however, this type also has considerable advantages which is one reason for the increase in use of this type. It must be assumed, here, that very great care is exercised when containers are loaded in harbour. There is no guarantee that the twistlocks are always attached to the corner fittings in one and the same relative position. However, this is a prerequisite for making it possible, by means of the position of the actuating lever (hand lever) for the locking bolt, to ascertain from outside whether the twistlock between the containers is in the locking position or the release position. The twistlocks are designed so that, when assembled properly the right way up, the hand lever always points to the left in the locking position. In a cargo inspection, it is consequently possible to ascertain visually, by checking the relative position of the hand lever, whether the twistlock is locked or not. This inspection is necessarily deficient if the twistlocks are fitted upside-down. This only applies to the type of twistlock mentioned first in the introduction.

This risk does not arise in a twistlock of the "permanent-base" type, because it is only possible to assemble it when the "anchoring foot" of the housing is directed downwards. In particular, for assembly, it is necessary for the housing to be rotated in the orifice in the corner fitting so that the lateral flanges of the foot can engage. In other words, the housing is inserted into the corner fitting and then rotated. Only after this rotation is the upper, still free crossbar aligned correctly, so that it can engage into the corner fitting of the upper container.

If such a twistlock is used the wrong way round by mistake, that is to say with the pivotable crossbar towards the bottom, the upward-directed anchoring foot of the housing would assume a position unsuitable for attaching the upper container. It would then be impossible for the corner fitting to be slipped over the twisted or skew anchoring foot. Consequently, errors are not possible with twistlocks of this type when containers are being loaded.

However, there still remains the above-described disadvantage of the relatively low load-bearing capacity.

OBJECTS AND SUMMARY OF THE INVENTION

The object of the invention is to improve the coupling piece mentioned in the introduction, in such a way that the advantages of the "permanent-base twistlock" are preserved, but the disadvantage of relatively low load-bearing capacity is avoided.

This object is achieved by means of the features indicated in the characterizing clause of patent claim 1.

The basic idea of the invention is that an "imitation" permanent-base twistlock, in which locking is also effected at the bottom via a pivotable crossbar, is provided. Here, in the released position, the lower crossbar assumes a relative position in relation to the housing or to the cone or middle part of the housing, where handling in the same way as with a permanent-base twistlock is required. In this position, the lower crossbar projects laterally beyond the cone or middle part by means of edge or corner regions. As a result of this, it can only be introduced into the corner fitting of the container when the housing has first been inserted in the rotated position and then rotated after insertion. After that, the lower crossbar is then moved into an essentially transverse locking position as a result of the actuation of the hand lever or the rotation of the locking bolt. The invention thus makes use of the construction principle of a "locking bolt" with two crossbars. On the other hand, however, the property of a permanent-base twistlock is also put into effect, specifically because of the appropriate initial position of the lower bar in the released position.

In the released position, the relative position of the crossbar is determined by stops or catches on the housing, in particular at the corners of the middle part.

Furthermore, when the twistlock is assembled incorrectly, that is to say upside-down, the function of the stops or catches is to prevent the possibility of a container nonetheless being placed on the container underneath it. This would be possible if there were no stops or catches, because the crossbar then wrongly located at the top could, under certain circumstances, be (forcibly) shifted by the weight of the container placed on it, until it could be forced through the corresponding orifice in the corner fitting. Moreover, the flat design of the (lower) crossbar also contributes to preventing the crossbar from being forcibly twisted when the twistlock is assembled the wrong way round.

BRIEF DESCRIPTION OF THE DRAWINGS

The invention is explained in detail below with reference to the drawing. In the drawing.

DESCRIPTION OF THE PREFERRED EMBODIMENT

Figure 1:
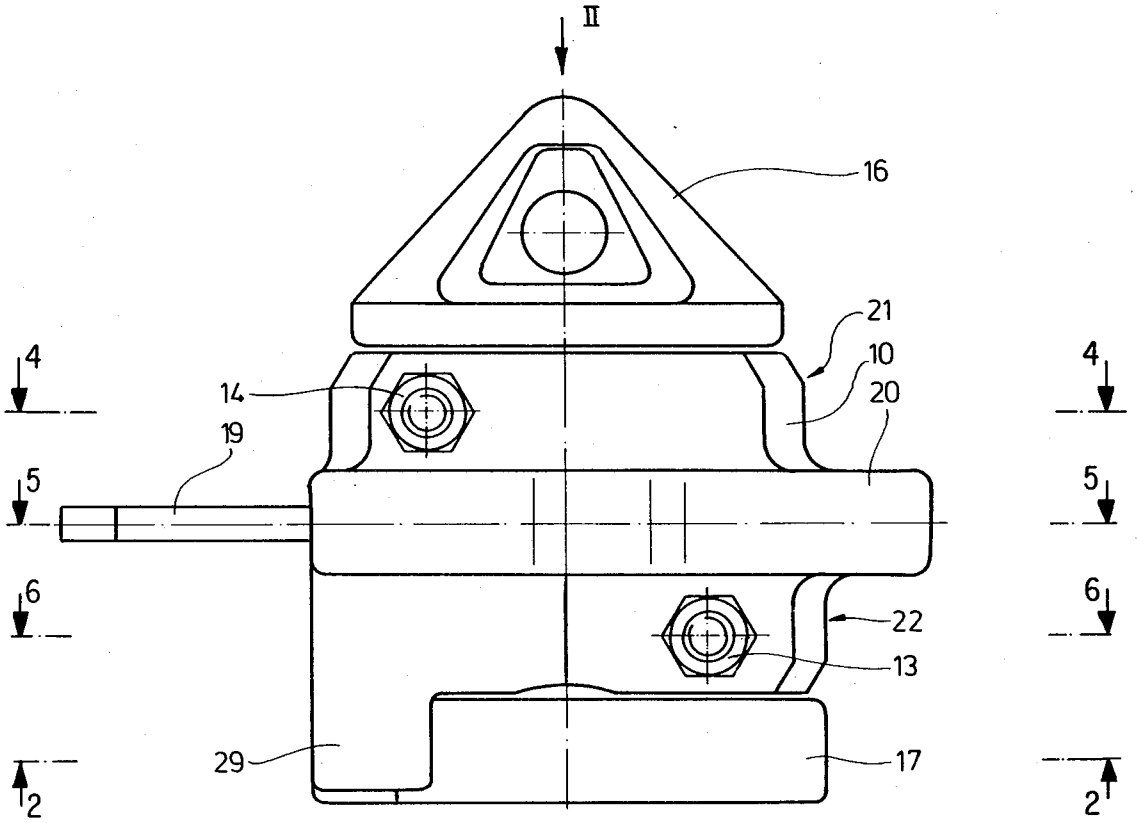
FIG. 1 shows a side view of the coupling piece according to the invention.

The coupling piece has a housing 10 which, here, is designed as a two-part housing with the housing parts 10 and 11. However, a one-part housing can also be used. The two housing parts 11 and 12 are connected to one another by means of screws 13 and 14 which are partially countersunk in the housing. Mounted in a bore extending through the housing is a rotatable locking bolt 15 which, at its two ends projecting from the housing 10, carries an upper (conical) crossbar 16 of conventional design and a lower, but flattened crossbar 17. Because of the flattening of the lower crossbar 17, the outwardly facing surface is generally planar, in contrast to the outwardly facing surface of the upper crossbar 14 which is generally conical. The locking bolt 15 and consequently the crossbars 16 and 17 connected firmly to it can be rotated jointly about the axis of the locking bolt 15, specifically via an actuating lever 19 projecting from a housing orifice 18 located approximately in the centre of the housing 10.

In the centre, the housing 10 has a widened portion 20, of which the surfaces directed upwards and downwards serve as abutments fo the containers or their corner fittings. On both sides of this widened portion 20, the housing has two middle parts 21 and 22 or cones which engage through the orifice in the container corner fitting and which match its contour.

Figure 2:
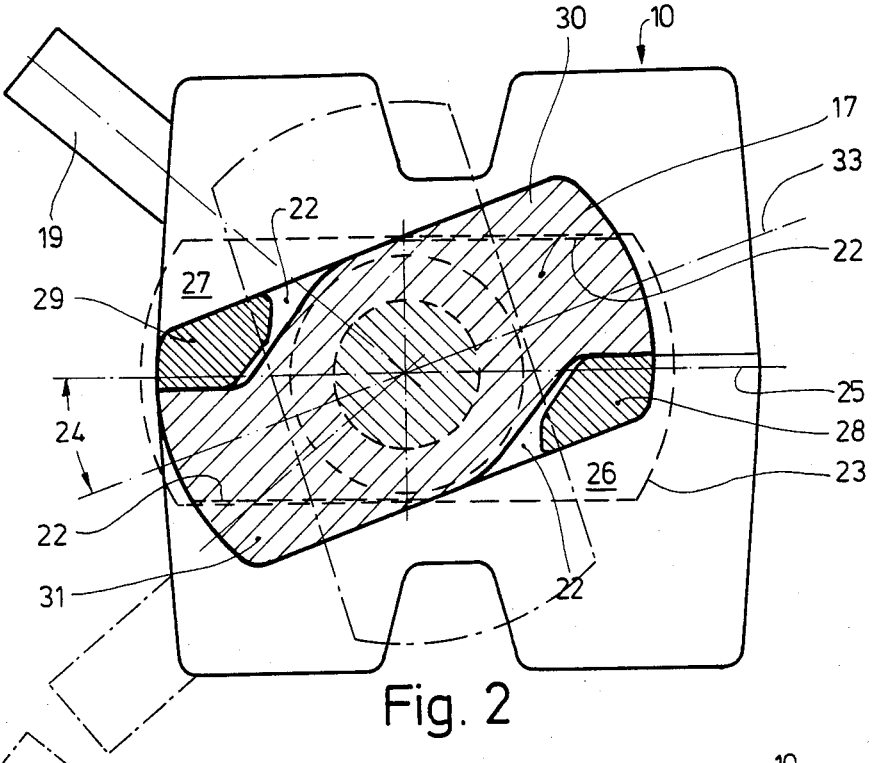
FIG. 2 shows a section along the line 2—2, as seen in the direction of the arrow I of FIG. 1.

According to the invention, the lower middle piece 22 and the lower crossbar 17 are of novel design. This emerges most clearly from FIG. 2. The orifice in the container corner fitting is represented there by the broken line, the coupling piece already being inserted and rotated through an angle 24. The middle piece 22 is represented by a broken line, its longitudinal axis 25 coinciding with the longitudinal axis of the orifice 23 in the container corner fitting. However, the middle piece 22 is cut off at two diagonally opposite corners in the regions 26 and 27, so that there its side wall does not rest against the inward-pointing wall of the orifice 23 of the container corner fitting.

Furthemore, the middle piece 22 has, adjacent to the cut-off regions 26 and 27, stops or catches 28 and 29 which project perpendicularly downwards and which are located diagonally opposite one another. In the opening position of the coupling piece shown in FIG. 2, the crossbar 17 is rotated through the angle 24 relative to the longitudinal axis 25 of the middle piece 22. It consequently projects laterally beyond the middle piece 22 by means of side portions 30 and 31 located opposite the catches 28 and 29. Furthermore, the crossbar 17 has recesses adjacent to the catches 28 and 29, so that, as seen in a plan view or in the sectional view of FIG. 2, the crossbar 17 and the two catches 28 and 29 form a complete contour which corresponds to the contour of the orifice 23 of the container corner fitting. The height of the catches 28 and 29 is somewhat less than the height of the lower crossbar 17. It can be seen from this that the housing can be introduced into the orifice 23 by means of the lower crossbar 17 in the opening position and can then be rotated as a whole through the angle 24, until the appropriate side walls of the middle piece 22 come to rest against the inner wall of the orifice 23 of the container corner fitting. This angle is, for example, 20°. During this rotation of the housing, the lower crossbar 17 is rotated with it at the same time, specifically likewise through the angle 24. The portions 30 and 31 thereby engage behind the container corner fitting (orifice 23), so that the coupling piece is temporarily fixed to the container corner fitting of the lower container. As a result of this rotation, in which the upper crossbar 16 also participates, the latter is adjusted in such a way that it is now aligned opposite the orifice in the container corner fitting of an upper container. Only then can the upper container be placed on top. In other words, the main axis 32 of the upper crossbar 16 is likewise rotated through the angle 24 relative to the main axis 33 of the lower crossbar.

After the upper container has been placed on top, the locking bolt 15 is rotated (in the counter-clockwise direction in FIG. 2) by means of the actuating lever 19, with the result that the two crossbars 16 and 17 are rotated further and locking is completed.

Figure 3:
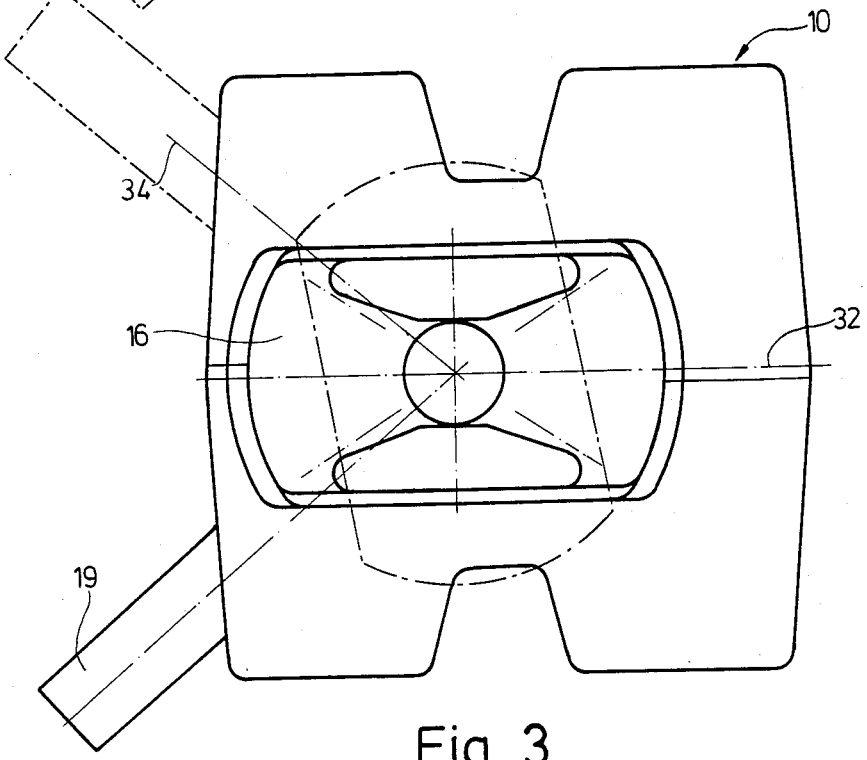
FIG. 3 shows a plan view of the top side of the coupling piece, as seen in the direction of the arrow II of FIG. 1.
Figure 5:
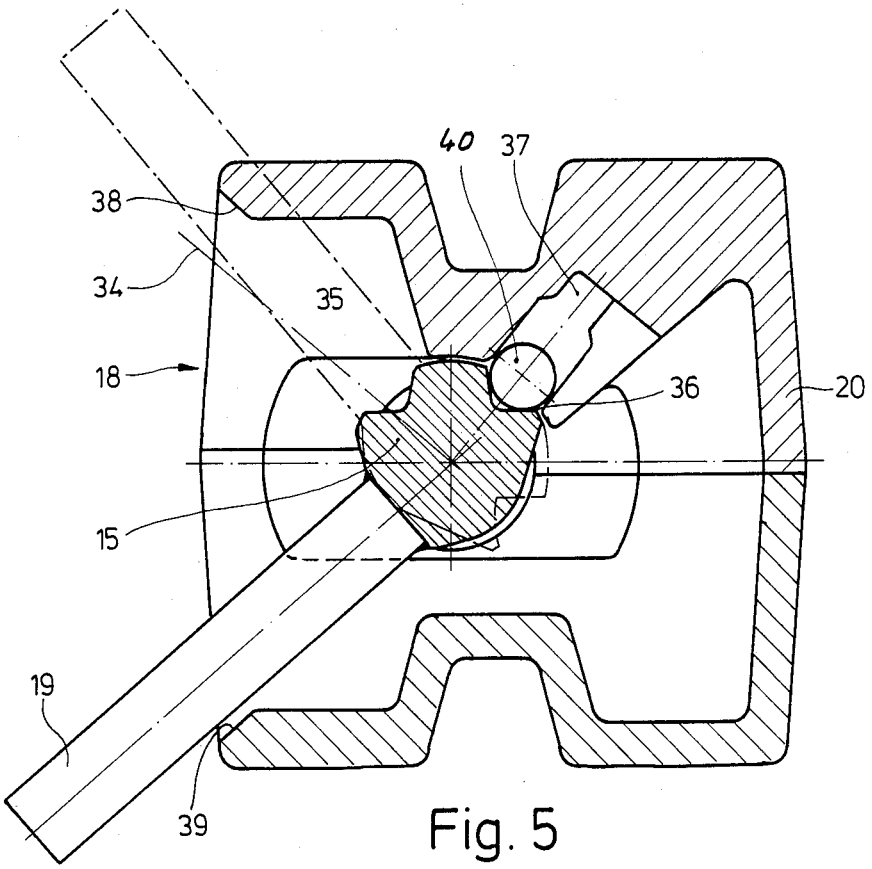
FIG. 5 shows a section along the line 5—5 of FIG. 1.

The rotating or pivoting range of the locking bolt 16 by means of the pivoting of the actuating lever 19 can be seen even more clearly in FIGS. 3 and 5. Here, the actuating lever 19 can be pivoted from the position shown into the position according to the line 34.

Figure 4:
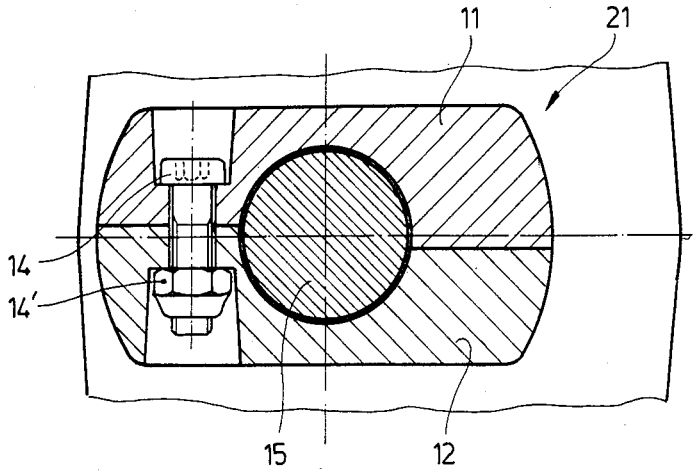
FIG. 4 shows a section along the line 4—4 of FIG. 1.

FIG. 4 shows a section along the line 4—4 of FIG. 1 and consequently a section through the upper middle piece 21. This also shows the mounting of the locking bolt 15 and the counter-sunk arrangement of the screw 14 and screwnut 14'.

FIG. 5 illustrates a section along the line 5—5 of FIG. 1. The actuating lever 19 is connected firmly to the locking bolt 15 which has, in the middle region of the widened portion 20, two engaging notches 35 and 36, into which a ball 40 prestressed by a spring 37 engages in the two limiting positions of the actuating lever 19. The housing orifice 18, from which the actuating lever 91 projects, can also be seen. In principle, this orifice is funnel-shaped, but at least has bevelled edges 38 and 39 which serve as stops for the actuating lever. The engagement device with the engaging notches 35 and 36 and the ball 40 serves primarily to prevent the actuating lever from being pivoted inadvertently.

Figure 6:
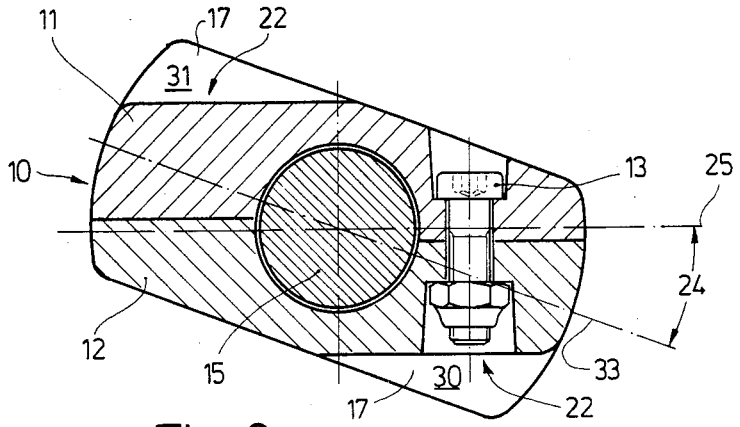
FIG. 6 shows a section along the line 6—6 of FIG. 1.

FIG. 6 shows a section along the line 6—6 of FIG. 1, that is to say a section through the lower middle piece 22. This again shows more clearly the shape of this middle piece and its alignment relative to the lower crossbar 17. It can be seen particularly how the crossbar projects laterally beyond the middle piece 22 by means of its regions 30 and 31 and how the main axes 25 and 33 of the middle piece and of the crossbar 17 respectively are offset relative to one another by the angle 24.

Figure 7:
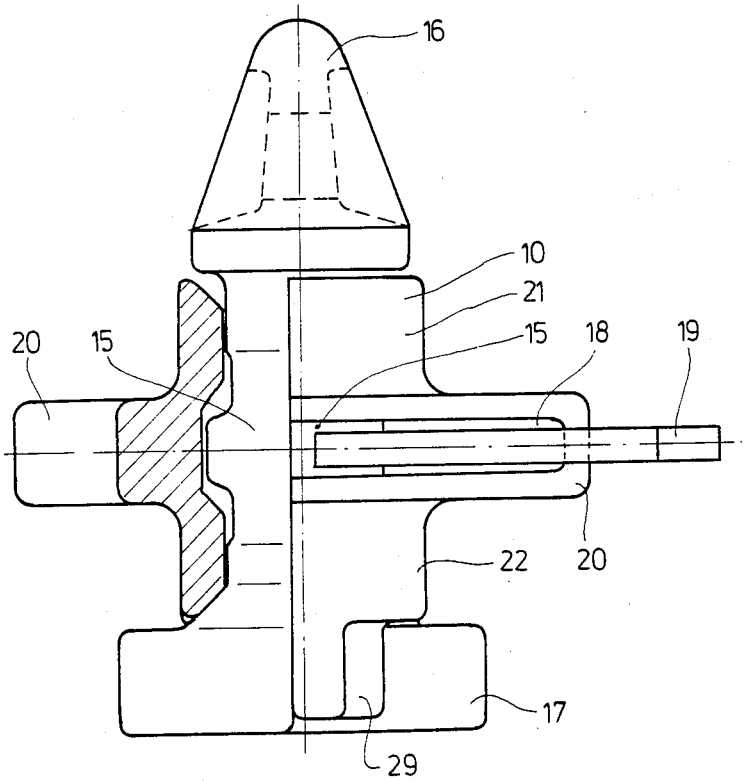
FIG. 7 shows a partially cut-away side view of the coupling piece, as seen in the direction of the arrow III of FIG. 1.

The side view of FIG. 7, as seen in the direction of the arrow III of FIG. 1, shows a view of the housing orifice 18 in more detail. Here, the upper crossbar 16 shows its narrow side whilst the lower cross bar 17 appears wider because it is rotated through the angle 24. Once again, it becomes very clear from this that, in the position according to FIG. 7, the two crossbars 16 and 17 cannot be introduced simultaneously into aligned orifices in container corner fittings. On the contrary, for this purpose, it is necessary for the lower crossbar 17 to be introduced first, then the housing rotated and then the upper crossbar 16 introduced into the corresponding container corner fitting.

I claim:

1. A coupling device for connecting containers, comprising:

a housing having continuously widening abutment, center parts arranged bilaterally therefrom and a continuous central opening;

a locking bolt mounted rotatably in the opening of the housing, with a first crossbar located at one end of the locking bolt outside the housing and a second crossbar located at the other end of the locking bolt outside the housing;

the first crossbar having a first longitudinal axis, and the secod crossbar having a second longitudinal axis offset from the first longitudinal axis by a predetermined angle;

the center part of the housing having corner portions which are arranged such that the center part may be rotated through the predetermined angle in an opening of a corner fitting of a container; and the center part of the housing having a pair of diametrically opposed stops, each projecting outwardly and protruding into a corresponding recess in the second crossbar and permitting limited rotation of the locking bolt.

2. The coupling device according to claim 1 wherein the middle part of the housing, when its longitudinal axis is aligned with the longitudinal axis of the orifice in the container corner fitting, has the general contour of but defined openings at corner portions which are adjacent to the stops.

3. The coupling device according to claim 1 wherein the second crossbar has a plane surface with end faces lying in two parallel horizontal planes.

4. A coupling device for connecting containers, comprising:

a housing having continuously widening abutment, center parts arranged bilaterally therefrom and a continuous central opening;

a locking bolt mounted rotatably in the opening of the housing, with a first crossbar located at one end of the locking bolt outside the housing and a second crossbar located at the other end of the locking bolt outside the housing;

the first crossbar having a first longitudinal axis, and the second crossbar having a second longitudinal axis offset from the first longitudinal axis by a predetermined angle;

the center part of the housing having corner portions which are arranged such that the center part may be rotated through the predetermined angle in an opening of a corner fitting of a container; and the center part of the housing having at least one stop projecting outwardly and protruding into a corresponding recess in the second crossbar;

characterized in that the second crossbar, in a released position, assumes a relative position in relation to the housing, which corresponds to the predetermined angle, and the first crossbar coincides with a main direction of the housing.

5. The coupling device according to claim 4 wherein the predetermined angle amounts to approximately 20°.

6. The coupling device according to claim 4, wherein the middle part of the housing adjacent to the second crossbar is designed so that, with its longitudinal axis rotated through the predetermined angle relative to the longitudinal axis of the orifice in the container corner fitting, the second crossbar can be inserted into the orifice.

7. A coupling device for connecting containers, comprising:

a housing having continuously widening abutment, center parts arranged bilaterally therefrom and a continuous central opening;

a locking bolt mounted rotatably in the opening of the housing, with a first crossbar located at one end of the locking bolt outside the housing and a second crossbar located at the other end of the locking bolt outside the housing;

the first crossbar having a first longitudinal axis, and the second crossbar having a second longitudinal axis offset from the first longitudinal axis by a predetermined angle;

the center part of the housing having corner portions which are arranged such that the center part may be rotated through the predetermined angle in an opening of a corner fitting of a container; and the center part of the housing having at least one stop projecting outwardly and protruding into a corresponding recess in the second crossbar.

wherein the second crossbar and said stop or stops define a joint contour which matches the contour of the orifice of the container corner fitting.

8. The coupling device according to claim 7, wherein the middle part of the housing has two stops which are located diagonally opposite one another and which have a smaller height than the second crossbar.

9. The coupling device according to claim 7 wherein the openings at the corner portions of the middle part of the housing symmetrically correspond to portions of the second crossbar which project laterally beyond the middle part of the housing.

* * * * *